US008047788B1

(12) United States Patent
Liang

(10) Patent No.: US 8,047,788 B1
(45) Date of Patent: Nov. 1, 2011

(54) TURBINE AIRFOIL WITH NEAR-WALL SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1047 days.

(21) Appl. No.: 11/975,672

(22) Filed: Oct. 19, 2007

(51) Int. Cl.
*F01D 5/18* (2006.01)

(52) U.S. Cl. ..... 416/97 R

(58) Field of Classification Search ..... 415/115; 416/96 R, 97 R, 97 A, 96 A
See application file for complete search history.

(56) References Cited

U.S. PATENT DOCUMENTS 3,220,697 A * 11/1965 Smuland et al. ..... 416/96 R
3,849,025 A * 11/1974 Grondahl ..... 416/97 R
4,859,147 A 8/1989 Hall et al.
5,484,258 A * 1/1996 Isburgh et al. ..... 415/115
6,247,896 B1 * 6/2001 Auxier et al. ..... 416/97 R
6,379,118 B2 4/2002 Lutum et al.
7,011,502 B2 3/2006 Lee et al.
7,293,962 B2 * 11/2007 Fried et al. ..... 416/97 R
7,390,168 B2 * 6/2008 Liang ..... 416/97 R
7,717,675 B1 * 5/2010 Liang ..... 416/95
7,857,589 B1 * 12/2010 Liang ..... 416/97 R

* cited by examiner

*Primary Examiner* — Edward Look
*Assistant Examiner* — Jesse Prager
(74) *Attorney, Agent, or Firm* — John Ryznic

(57) ABSTRACT

A turbine airfoil with a leading edge cooling air supply channel located along the leading edge region of the airfoil to supply cooling air from an outside source and a series of serpentine flow cooling circuits positioned along the leading edge of the airfoil connected to the cooling supply channel to pass cooling air through the series of serpentine passages in a direction from the airfoil root to the airfoil tip. The series of serpentine circuits includes legs on the pressure side and the suction side of the leading edge. Cooling air from the supply channel is metered into the first leg of the serpentine circuit located near the root, flows through a series of serpentine circuits along the leading edge of the airfoil, and flows out to the tip through a tip hole in the last leg of the last serpentine circuit.

14 Claims, 3 Drawing Sheets

TURBINE AIRFOIL WITH NEAR-WALL SERPENTINE COOLING

CROSS-REFERENCE TO RELATED APPLICATIONS

This application is related to co-pending U.S. regular application Ser. No. 11/503,549 to George Liang filed Aug. 11, 2006 and entitled TURBINE AIRFOIL WITH MINI-SERPENTINE COOLING PASSAGES; and co-pending U.S. Regular application Ser. No. 11/508,013 to George Liang filed on Aug. 21, 2006 and entitled TURBINE BLADE TIP WITH MINI-SERPENTINE COOLING CIRCUIT; and to U.S. Regular application Ser. No. 11/521,748 to George Liang filed on Sep. 15, 2006 and entitled TURBINE AIRFOIL WITH NEAR-WALL MINI-SERPENTINE LEADING EDGE COOLING PASSAGE; and co-pending U.S. regular application Ser. No. 11/903,558 to George Liang filed on Sep. 21, 2007 and entitled TURBINE AIRFOIL WITH NEAR-WALL COOLING, all of which are incorporated herein by reference.

BACKGROUND OF THE INVENTION

1. Field of the Invention

The present invention relates generally to fluid reaction surfaces, and more specifically to leading edge cooling of airfoils in a gas turbine engine.

2. Description of the Related Art Including Information Disclosed Under 37 CFR 1.97 and 1.98

A gas turbine engine includes a turbine section in which a high temperature gas flow passes through the rotor blades and stationary vanes or nozzles to extract energy from the flow. The efficiency of the gas turbine engine can be increased by providing a higher flow temperature into the turbine. However, the temperature is limited to the material capabilities of the parts exposed to the hot gas flow.

One method of allowing for higher turbine temperatures is to provide cooling of the first and second stages of the turbine. Complex internal cooling passages have been disclosed to provide high cooling capabilities while using lower flow volumes of cooling air. Since the cooling air used in the turbine airfoils is typically bleed off air from the compressor, using less bleed off air for cooling also increases the efficiency of the engine.

A Prior Art first stage turbine blade is shown in FIG. 1. The turbine blade 10 includes a cooling air supply cavity 11 along the leading edge with drilled film cooling holes forming a leading edge showerhead 12 arrangement and suction side film cooling holes 13 supplied with cooling air form the supply cavity 11. a mid-chord cooling supply channel 14 supplies cooling air to a 3-pass serpentine flow cooling circuit with a second leg 15 and a third leg 16 in which each of the three channels 14,15,16 includes pressure side film cooling holes 17 to discharge film cooling air from the respective channel onto the airfoil surface to provide film cooling. A trailing edge cooling supply channel 18 supplies cooling air to the trailing edge and discharges cooling air through pressure side film cooling holes and trailing edge exit holes 20 arranged along the trailing edge of the airfoil. Exit cooling slots could also be used to discharge the cooling air from the supply channel 18 and out the trailing edge region of the airfoil. FIG. 2 shows a cross section side view of the prior art turbine blade of FIG. 1 with the three cooling supply channels and the 3-pass serpentine flow cooling circuit in the mid-chord region of the blade. Cooling air is also discharged out the blade tip through blade tip cooling holes as shown by the arrows in FIG. 2.

In the prior art first stage turbine blade leading edge cooling construction of FIG. 1 and FIG. 2, a single pass radial flow cooling circuit is used for the airfoil leading edge region. However, the single pass radial flow cooling channel with the drilled film cooling holes design is not the best method of utilizing the cooling air and results in a low convective cooling effectiveness.

U.S. Pat. No. 7,011,502 B2 issued to Lee et al on Mar. 14, 2006 entitled THERMAL SHIELD TURBINE AIRFOIL. Discloses an airfoil with a longitudinal first inlet channel (56 in this patent) connected by a row of impingement holes (48 in this patent) to a longitudinal channel (42 in this patent), being connected by a plurality of film cooling holes (50 in this patent) to the leading edge surface of the airfoil. In the Lee et al patent, the longitudinal channel is also connected to bridge channels on the pressure side and suction sides of the longitudinal channel. Only one multi-impingement channel is used in the Lee et al invention to supply film cooling holes as opposed to the three separate multi-impingement channels of the present invention.

U.S. Pat. No. 4,859,147 issued to Hall et al on Aug. 22, 1989 entitled COOLED GAS TURBINE BLADE discloses an airfoil with a showerhead arrangement having a cooling air supply cavity (24 in this patent), an impingement cavity (28 in this patent) connected to the cooling supply cavity by three slots (26 in this patent), and three film cooling holes (30 in this patent) connected to the impingement cavity.

U.S. Pat. No. 6,379,118 B2 issued to Lutum et al on Apr. 30, 2002 entitled COOLED BLADE FOR A GAS TURBINE discloses a similar showerhead arrangement to that above of the Hall et al patent. A cooling air supply cavity (50 in this patent) is connected to an impingement cavity (47 in this patent) through two impingement cooling holes (49 in this patent), and three film cooling holes (48 in this patent) are connected to the impingement cavity. Both of the Hall et al and Lutum et al patents lack the first impingement cavity and the second impingement cavity in series, and the multi-impingement cavities of the present invention.

BRIEF SUMMARY OF THE INVENTION

It is an object of the present invention to provide for a turbine airfoil with a leading edge cooling circuit that will greatly reduce the airfoil leading edge metal temperature and thus reduce the cooling air flow requirement and improve the turbine efficiency.

A turbine airfoil with a leading edge region in which a series of 3-pass or 5-pass near-wall serpentine flow cooling circuits are connected in series to flow from the root to the tip of the airfoil in series in order to provide near-wall cooling for the leading edge of the airfoil. The near-wall serpentine flow cooling circuits extend from the pressure side to the suction side of the leading edge of the airfoil. A leading edge cooling air supply channel supplies cooling air to the first leg of the first leading edge serpentine flow cooling circuit located near the airfoil root, and the cooling air flows through the serpentine passage and then into the next near-wall serpentine circuit above the first serpentine circuit. A series of serpentine flow circuits extend along the leading edge and are connected such that the cooling air flows in series through the near-wall serpentine circuits toward the airfoil tip. Each channel within the serpentine flow circuits includes film cooling holes to discharge film cooling air from the respective channels of the serpentine flow circuits onto the pressure side or suction side surface of the leading edge to provide film cooling for the airfoil.

DETAILED DESCRIPTION OF THE INVENTION

Figure 1:
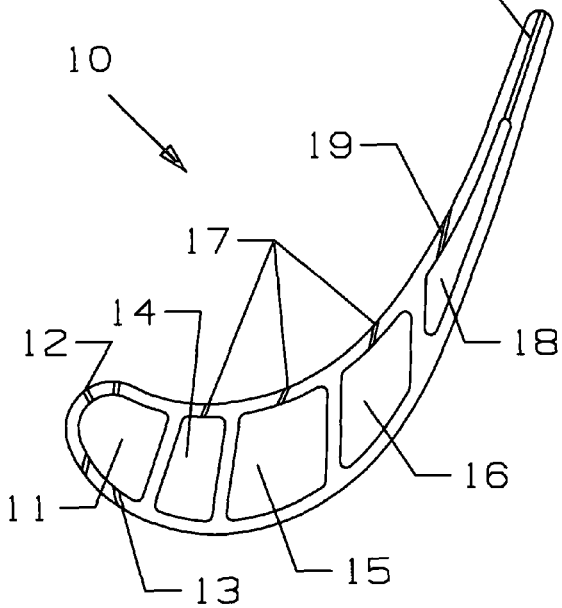
Fig 1 Prior Art
FIG. 1 shows a top view of a cross section of a first stage turbine blade of the prior art with a leading edge region cooling circuit.
Figure 2:
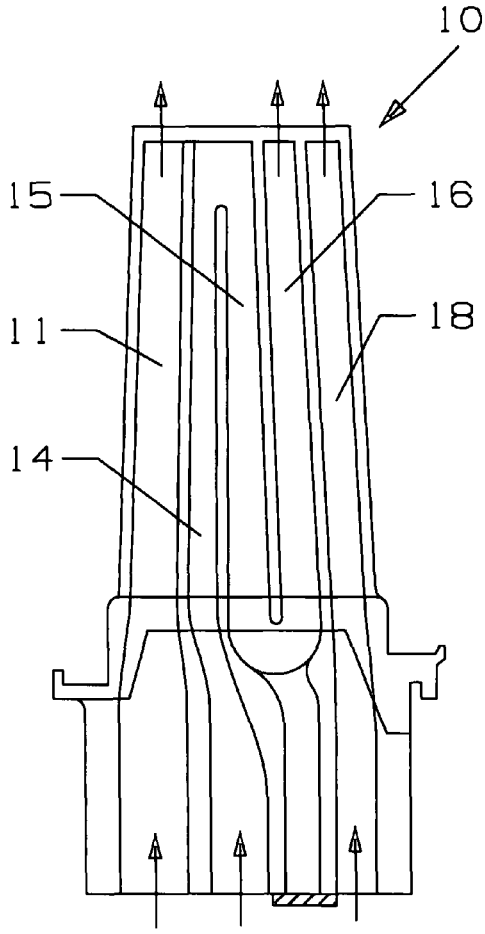
Fig 2 Prior Art
FIG. 2 shows a side cross section view of the cooling circuit of the prior art turbine blade in FIG. 1.
Figure 3:
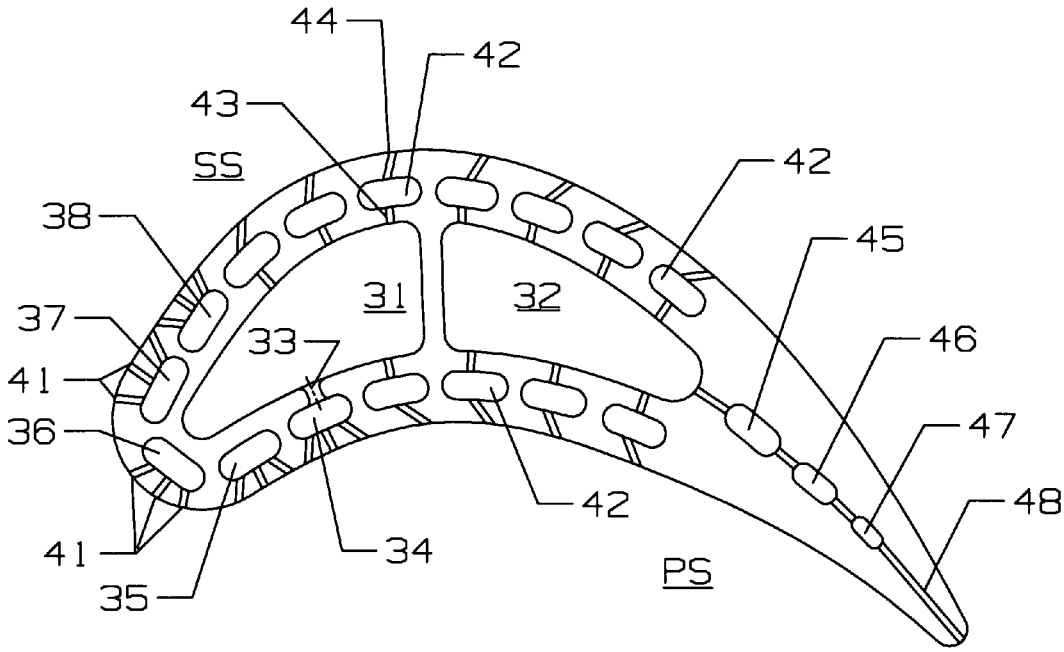
FIG. 3 shows a top cross section view of the turbine airfoil with the leading edge cooling circuit of the present invention.

The air cooled turbine airfoil of the present invention is shown in FIG. 3 in which a cooling supply channel 31 extends along the leading edge of the airfoil to supply cooling air for the leading edge region. A trailing edge cooling supply channel 32 also supplies cooling air to the airfoil to provide cooling for the trailing edge region. Additional cooling supply channels can be included within the airfoil and positioned between the channels 31 and 32 to provide additional cooling capability. Also, the turbine airfoil can be for a rotor blade or a stator vane.

Figure 4:
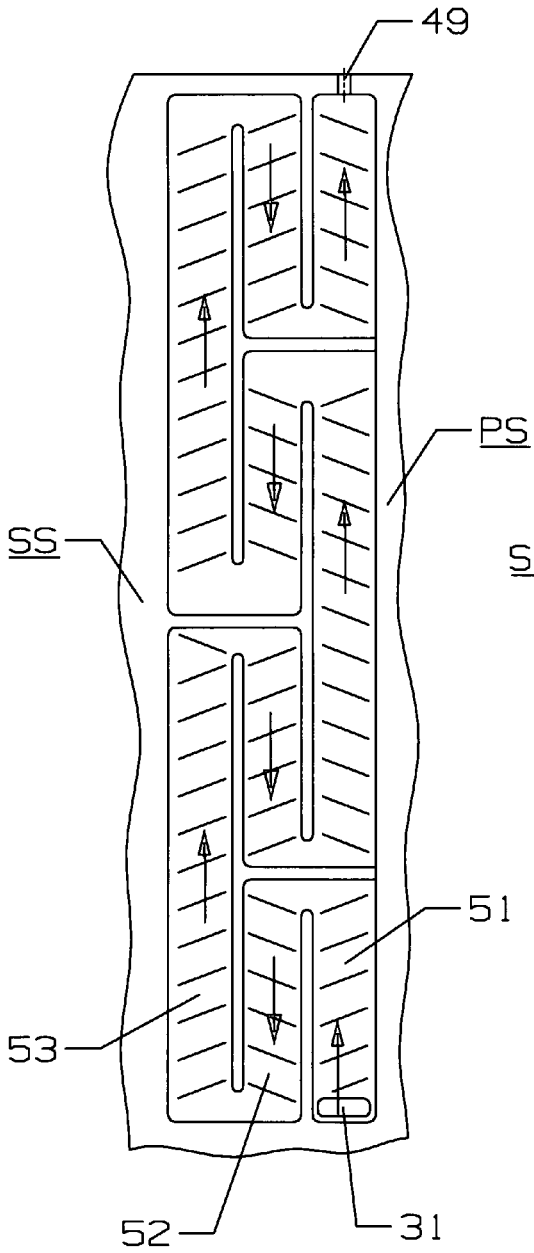
FIG. 4 shows a front view of a cross section of the leading edge cooling circuit of the present invention using a series of 3-pass serpentine flow circuits.
Figure 5:
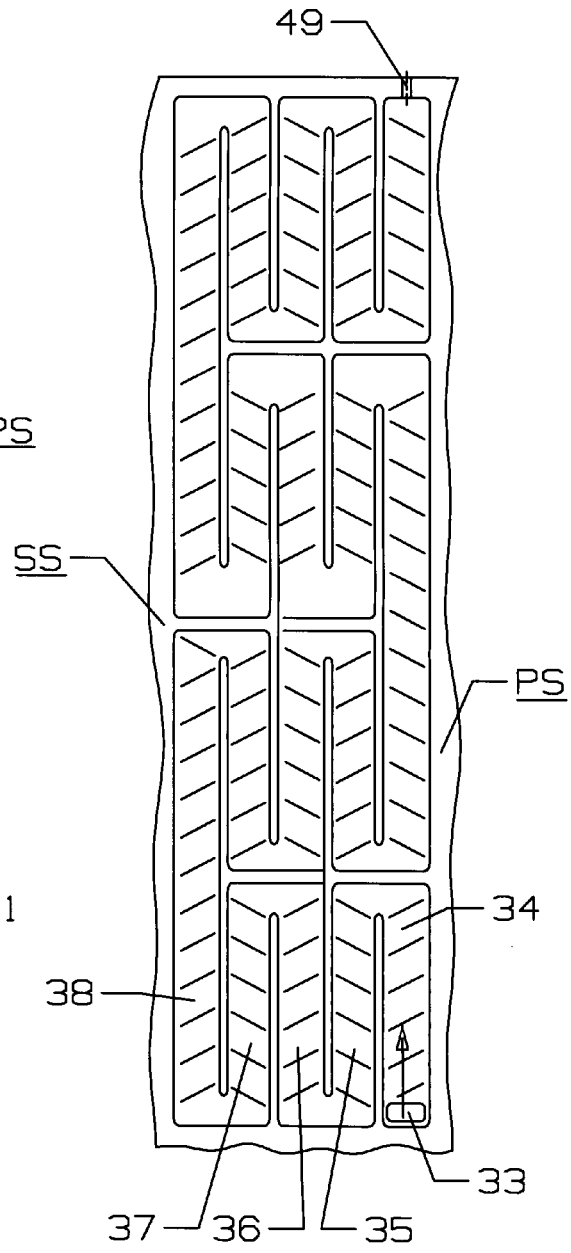
FIG. 5 shows a front view of a cross section of the leading edge cooling circuit of the present invention using a series of 5-pass serpentine flow circuits.

The present invention includes a series of serpentine flow cooling circuits extending along the leading edge of the airfoil. FIG. 4 shows one embodiment in which the leading edge cooling circuits include 3-pass serpentine flow circuits and FIG. 5 shows them as 5-pass serpentine flow circuits. In FIG. 3, the 5-pass serpentine flow circuits are used. An inlet metering and impingement hole 33 connects the leading edge supply channel 31 to a first leg 34 of the first 5-pass serpentine flow cooling circuit extending across the leading edge of the airfoil. The first leg 34 is located on the pressure side of the airfoil and flows upward toward the airfoil tip as seen in FIG. 5. The second leg 35 is positioned also on the pressure side of the airfoil and flows downward toward the airfoil root. The third leg 36 is positioned along the leading edge of the airfoil and flows toward the tip. The fourth leg 37 is located on the suction side and flows downward toward the root. The fifth and last leg 38 flows upward toward the tip. The five legs are connected in series to form the serpentine flow passage along the leading edge of the airfoil from the pressure side to the suction side. Each of the legs includes one or more film cooling holes 41 to discharge film cooling air from the respective leg and onto the surface of the airfoil to provide film cooling. Not all of the legs in the serpentine flow circuit require film cooling holes, however. The film cooling holes can be used where the airfoil surface requires film cooling. The first leg 34 is considered to be the supply leg and the fifth leg 38 is considered to be the discharge leg of the 5-pass serpentine flow circuit.

Cooling air from the first 5-pass serpentine flow circuit continues to flow into an adjacent 5-pass serpentine circuit located immediately above the first 5-pass serpentine circuit. FIG. 5 shows the second 5-pass serpentine circuit in which the first leg is supplied with cooling air from the fifth or last leg of the 5-pass serpentine circuit located below or upstream in the cooling air flow direction. The second 5-pass serpentine circuit flow also includes 5 legs but flows from the suction side to the pressure side of the airfoil. Some or all of the five legs in the second 5-pass serpentine circuit can include film cooling holes 41 to discharge film cooling air from the legs and onto the airfoil surface.

This series of alternating 5-pass serpentine circuits continues along the airfoil leading edge toward the airfoil tip in which the 5-pass serpentine circuits alternate in the flow direction (from pressure side to suction side, then suction side to pressure side) and in which all of the 5-pass serpentine circuits are connected in series. FIG. 5 shows four individual 5-pass serpentine circuits connected in series in which the last leg of the upstream 5-pass serpentine circuit is connected to the first leg of the next 5-pass serpentine circuit. The last 5-pass serpentine circuit located at the airfoil tip includes at least one tip cooling hole 49 to discharge cooling air in the last leg onto the airfoil tip surface. Each of the 5-pass serpentine circuits can include one or more film cooling holes 41 in some or all of the five legs that form the 5-pass serpentine circuit.

FIG. 4 shows a second embodiment of the series arrangement of serpentine flow circuits positioned along the airfoil leading edge in which the serpentine circuits are 3-pass serpentine circuits. The first leg 51 is located on the pressure side of the airfoil and is connected to the leading edge cooling supply channel 31 through the metering and impingement hole 31. The second and middle leg 52 is located at the leading edge of the airfoil, and the third and last leg 53 is located on the suction side of the airfoil. The cooling supply channel 31 delivers cooling air through the metering and impingement hole 31 into the first 3-pass serpentine circuit located near the platform of the airfoil. A series of 3-pass serpentine circuits extend along the leading edge from the platform to the tip with each connected in series as in the 5-pass serpentine circuit of the first embodiment. The last leg of the upstream 3-pass serpentine circuit will discharge into the first leg of the adjacent downstream 3-pass serpentine circuit but with the cooling air flow direction alternating from pressure side to suction side and then suction side to pressure side and seen in FIG. 4. An airfoil tip cooling hole 49 connects the last leg of the last 3-pass serpentine circuit to discharge cooling air onto the tip of the airfoil. The first leg 51 is considered to be the supply leg and the third leg 53 is considered to be the discharge leg of the 3-pass serpentine flow circuit.

In each of the 5-pass and 3-pass serpentine circuits, the legs can include trip strips along the passage walls to promote turbulent flow of the cooling air to increase the heat transfer coefficient. In the case of a turbine rotor blade, the cooling air will be forced to flow along the series of passages from the blade root toward the blade tip because of the centrifugal force imposed onto the cooling air from the rotation of the blade during engine operation. Thus, the cooling air pressure will not decrease below the required level to force the cooling air into the last leg of the last serpentine circuit. This also provides enough cooling air pressure to discharge the cooling air through the film cooling holes 41 positioned in the legs of the serpentine circuits.

The leading edge cooling supply channel 31 and the trailing edge cooling supply channel 32 also discharge cooling air into radial passages 42 formed within the walls of the airfoil on the pressure side and the suction side to provide cooling to the region away from the leading edge. Metering and impingement holes 43 connect the supply channels 31 and 32 to a radial passage 42, and film cooling holes 44 connect the radial passage 42 to the airfoil surface on the pressure side or the suction side.

The trailing edge region also includes exit holes 48 positioned along the trailing edge of the airfoil. Each exit hole 48 is connected to the trailing edge supply channel 32 through a series of 3 impingement cavities (45, 46 and 47) through metering holes.

The near-wall serpentine cooling circuits connected in series along the leading edge of the airfoil is channeled in a maze formation. Each individual 3-pass or 5-pass serpentine circuit can be designed based on the airfoil local external heat load to achieve a desired local metal temperature. The usage of cooling air is maximized for a given airfoil inlet gas temperature and pressure profile. Also, the series of serpentine circuits yields a higher internal convection cooling effectiveness than the single radial flow cooling design of the prior art. In the present invention, since the cooling air is serpentine through the maze of serpentine circuits in series from the blade root to the blade tip, fresh cooling air provides cooling for the blade root section first. This enhances the blade leading edge High Cycle Fatigue (HCF) capability. The cooling air increases temperature in the series of serpentine circuits as it flows outward and therefore induces hotter metal temperature at the upper blade span. However, the pull stress at the blade upper span is much lower than at the blade lower span and therefore the allowable blade metal temperature can be high. A balanced thermal design for a turbine blade is achieved by the cooling circuits of the present invention.

I claim the following:

1. A turbine airfoil for use in a gas turbine engine, the turbine airfoil comprising:

a cooling air supply channel connected to an outside source of pressurized cooling air;

a first serpentine flow cooling circuit located along a leading edge of the turbine airfoil, the first serpentine flow cooling circuit having a supply leg located on the pressure side of the airfoil and a discharge leg located on the suction side of the airfoil;

a second serpentine flow cooling circuit located along the leading edge of the turbine airfoil and adjacent to the first serpentine flow cooling circuit, the second serpentine flow cooling circuit having a supply leg located on the suction side of the airfoil and a discharge leg located on the pressure side of the airfoil;

the discharge leg of the first serpentine flow cooling circuit is connected to the supply leg of the second serpentine flow cooling circuit such that cooling air from the discharge leg of the first serpentine flow cooling circuit flows into the supply leg of the second serpentine flow cooling circuit; and, a metering hole to connect the cooling air supply channel to the first leg of the first serpentine flow cooling circuit.

2. The turbine airfoil of claim 1, and further comprising:

the first and the second serpentine flow cooling circuits are each either 3-pass or 5-pass serpentine circuits.

3. The turbine airfoil of claim 1, and further comprising:

some of the legs of the serpentine circuits include a film cooling hole to discharge film cooling air onto the surface of the airfoil.

4. The turbine airfoil of claim 1, and further comprising:

the cooling supply channel is located adjacent to the leading edge of the airfoil.

5. The turbine airfoil of claim 1, and further comprising:

a last leg of the serpentine circuit located adjacent to the tip of the airfoil includes an airfoil tip cooling hole to discharge cooling air from the last leg onto the tip.

6. The turbine airfoil of claim 1, and further comprising:

the airfoil leading edge includes a series of serpentine circuits extending from the airfoil root to the airfoil tip, the series of serpentine circuits being connected such that cooling air from the last leg of a lower serpentine circuit flows into the first leg of the serpentine circuit located immediately above the upstream serpentine circuit in the spanwise direction of the airfoil toward the tip.

7. The turbine airfoil of claim 6, and further comprising:

the series of serpentine circuits alternate from a pressure side to a suction side flow.

8. The turbine airfoil of claim 6, and further comprising:

the serpentine circuit located adjacent to the root includes a first leg connected to the metering hole; and, the serpentine circuit located adjacent to the tip includes a tip cooling hole connected to the last leg.

9. The turbine airfoil of claim 6, and further comprising:

some of the legs of the serpentine circuits include a film cooling hole to discharge film cooling air from the respective leg onto the airfoil surface.

10. The turbine airfoil of claim 1, and further comprising:

the pressure side wall and the suction side wall of the airfoil includes at least one radial cooling channel connected to the cooling supply channel through a metering hole, and each radial channel includes a film cooling hole to discharge cooling air form the radial channel onto the surface of the airfoil.

11. The turbine airfoil of claim 1, and further comprising:

a trailing edge cooling supply channel;

an exit cooling hole on the trailing edge of the airfoil; and, cooling air metering and impingement means connecting the trailing edge supply channel to the exit hole to discharge cooling air from the trailing edge supply channel out from the trailing edge of the airfoil.

12. The turbine airfoil of claim 6, and further comprising:

trip strips on the walls of the serpentine circuits along the leading edge to increase the heat transfer coefficient.

13. The turbine airfoil of claim 2, and further comprising:

the middle legs of the serpentine circuits are located along the stagnation point of the leading edge of the airfoil.

14. The turbine airfoil of claim 1, and further comprising:

the airfoil is a rotor blade and the cooling flow within the series of serpentine circuits flows in a direction from blade root to blade tip.

* * * * *